United States Patent [19]

Corzine et al.

[11] Patent Number: 4,525,720

[45] Date of Patent: Jun. 25, 1985

[54] INTEGRATED SPIRAL ANTENNA AND PRINTED CIRCUIT BALUN

[75] Inventors: Robert G. Corzine; Joseph A. Mosko, both of Ridgecrest, Calif.

[73] Assignee: The United States of America as represented by the Secretary of the Navy, Washington, D.C.

[21] Appl. No.: 434,651

[22] Filed: Oct. 15, 1982

[51] Int. Cl.[3] ..... H01Q 1/36

[52] U.S. Cl. ..... 343/895

[58] Field of Search ..... 343/895, 700 MS, 829, 343/846

[56] References Cited

U.S. PATENT DOCUMENTS

| | | | |
|---|---|---|---|
| 2,958,081 | 10/1960 | Dyson | 343/895 |
| 3,241,148 | 3/1966 | Lechtreck | 343/895 |
| 3,509,465 | 4/1970 | Andre et al. | 343/895 |
| 3,656,168 | 4/1972 | Stropki | 343/895 |
| 4,085,406 | 4/1978 | Schmidt et al. | 343/895 |

*Primary Examiner*—Eli Lieberman

*Attorney, Agent, or Firm*—Robert F. Beers; W. Thom Skeer; W. D. English

[57] ABSTRACT

A unidirection circularly polarized dual armed spiral antenna of a stripline printed circuit configuration is disclosed. The antenna is powered by a planar, edge connected, balun. The radial arms may be configured to spiral in any one of a multiplicity of different patterns and are not limited solely to Archimedean or logarithmic spirals.

19 Claims, 5 Drawing Figures

INTEGRATED SPIRAL ANTENNA AND PRINTED CIRCUIT BALUN

BACKGROUND OF THE INVENTION

1. Field of the Invention

This invention relates to antenna systems in general and in particular to spiral antennas and feed systems. More particularly, this invention relates to antennas which provide a unidirectional, broadband, circularly polarized radiation beam centered on the spiral axis.

2. Description of the Prior Art

It is well understood that if the dimensions of an antenna are doubled and at the same time the wavelength is doubled, the performance of a log spiral antenna remains the same. More specifically, the impedance, polarization and pattern are invariant to a change of scale that is in proportion to the change in wavelength, provided the antenna is made of nearly perfect conductors and dielectrics. Therefore, if an antenna's shape is entirely determined by angles, the performance is independent of frequency, for such a shape would be invariant to a change of scale. In addition to this angle principle, it is necessary that the shape also fit a truncation principle.

The foregoing led to the development of conical and planar sheet equiangular spiral antennas which fit both the angle and truncation principles. However, frequency independent operation is actually observed only over a limited band. The low frequency limit is set by the maximum dimension, and the high frequency limit is set by how precisely the input terminal region balanced connector (the balun) can be constructed.

To illustrate the general approach, we consider all plane curves which remain essentially the same when scaled to a different unit of length. Such curves are used to determine the shape of a plane sheet antenna by taking the input terminals at the common point of intersection of two curves. It follows then that the antenna is unchanged when scaled to a different wavelength, provided the terminals stay fixed when the scale is changed. The fact that a typical curve remains essentially unchanged by a change of scale implies that the new curve can be made to coincide with the old curve by translation and rotation. Since a translation is eliminated by the requirement that the common point remain fixed, the problem is to determine all curves such that a change of scale is equivalent to a rotation. Stated symbolically:

$$K\, r(\phi) = r(\phi + C) \tag{1}$$

where r ($\phi$) denotes the radius r as a function of the polar angle $\phi$, K is the scale change, and C is the angle of rotation to which it is equivalent. Thus K depends on C, but K and C are independent of $\phi$ and r. Therefore:

$$r(\phi)\frac{dK}{dC} = \frac{\partial r(\phi + C)}{\partial C} \tag{2}$$

$$K\frac{dr(\phi)}{d\phi} = \frac{\partial r(\phi + C)}{\partial \phi} \tag{3}$$

However, $$\frac{\partial r(\phi + C)}{\partial C} = \frac{dr(\phi + C)}{d(\phi + C)} = \frac{\partial r(\phi + C)}{\partial \phi} \tag{4}$$

Therefore:

$$r(\phi)\frac{dK}{dC} = K\frac{dr(\phi)}{d\phi} \tag{5}$$

or $$dr/d\phi = ar \tag{6}$$

where a is inependent of $\phi$ and is defined as:

$$a = (1/K)(dK/dC) \tag{7}$$

But from (6):

$$\int (dr/d\phi) = \int ar \tag{8}$$

$$r = r_o e^{a\phi} \tag{9}$$

$r_o$ being a constant $$\text{Let } r_o = e^{a\phi_o} \tag{10}$$

$\phi_o$ being a constant

Then from (9):

$$r = e^{a\phi_o} \cdot e^{a\phi} \tag{11}$$

or $$r = e^{a(\phi + \phi_o)}$$

Taking the natural log of both sides we get:

$$\phi + \phi_o = (1/a)\ \ln r \tag{12}$$

The derived formula for an equiangular spiral, so indicates that the shape of all plane sheet frequency independent antennas must be defined by equiangular spirals.

While antennas with log spirals ($r = e^{a\phi}$) are frequency independent, it is also well known that Archimedean spirals ($r = a\phi$) are well behaved broadband antennas. Furthermore, two arm Archimedean spirals over moderate bandwidths often out perform log spirals of comparable dimensions because more spiral turns can usually be incorporated with the Archimedean than the log spiral. Of course, while the log and Archimedean spirals are unique classical spirals of different growth rates, there is as described in the present invention an infinite class of spirals in addition to those two prior art examples, which we simply call general growth rate spirals ($r = f(\phi)$).

Two dimensional antennas made out of a sheet of metal, or as in the present design by masking two thin matching copper spirals, one on each side of a non-conductive substrate, can be fed successfully by a coaxial line; however, a mode converter from the coaxial to biaxial geometry is needed (more commonly known as a balun).

Many different baluns have been invented, only some of which are in fact true mode converters, and fewer still that are frequency independent.

One such frequency independent type is simply a gradual transition from coaxial to biaxial cross-section, which clearly must accomplish the mode conversion if the transition is spread out over a sufficient number of wavelengths.

In prior art, the outer conductor of the coaxial line is gradually cut away so that after some distance less than half of it remains. At this point the resemblance to a pair of wires is clear, and a smooth deformation to the biaxial geometry easily follows; however, at microwave frequencies the cross-section becomes so small that the necessary precision of construction becoms very hard to obtain. Therefore, a different version was developed by etching copper from both sides of a thin dielectric sheet. The outer conductor of the coaxial line fits into a hole in the lower plate and the inner conductor is connected to the upper plate.

In the prior art, this connection was made orthogonally through the center of the spiral antenna; however such perpendicular mounting carried with it substantial limitations with respect to mounting or integrating the antenna within a system and further could induce coupling error at high frequency.

Other prior art provided for an antenna fed by a balanced line (coax) brought into the center point aong the axis; i.e. using a coaxial cable embedded into one arm of the spiral. For symmetry a dummy cable was sometimes soldered to the other arm of the spiral in a similar configuration.

Limitations of these prior art devices led to the need and fulfillment of that need in the present invention. The present invention describes an improvement over prior art dual, spiral, planar antennas which as described above were fabricated by etching copper on both sides of a thin dielectric sheet and positioning inputs to said spirals orthogonally to the spiral plane and centrally positioned with respect to the spiral.

The present invention describes a substantial improvement over prior art spiral antenna technology by providing a parallel (planar) edge connecting capability (balun) as opposed to an orthogonal, centrally mounted balun input. By such means a spiral antenna can be mounted in aircraft or missile components in a manner that heretofore was impossible or at least difficult, cumbersome, and manpower costly.

In addition, since the dual spiral is fabricated by etching copper on both sides of a thin dielectric sheet, and having an input connection on one edge thereof, it should be readily apparent that a plurality of such antennas can be mounted and interconnected on a planar surface in connection with or as an extension of an integrated circuit. In fact, lowpass, highpass, or bandpass filters could be etched into the spiral plate itself eliminating needless discrete component cost in fabrication thereof and for making a very compact unit.

Another advantage of this invention is improved performance of the antenna over an extended frequency range by close coupling and limited interference from the input junction (balun). By providing the balun on the outer wing of the spiral where longer wavelengths and lower frequencies are associated, balun interference is substantially curtailed as opposed to prior art where the balun was centrally mounted on the spiral and where smaller wavelengths and higher frequencies are associated.

In addition, the present invention describes a general spiral ($r=f(\phi)$) that can be implemented in addition to prior art log spirals ($r=e^{a\phi}$) or Archimedean spirals ($r=a\phi$).

A further improvement in the present invention over the prior art is that a stripline configuration is implemented wherein the conductor spiral of the prior art microstrip orientation in addition to using the second radiating spiral as a ground plane is provided with a counter-opposed radiating spiral, ground plane on the opposite surface of the conductor thereby providing a double ground plane and thereby effectively eliminating any stray interference from the electric field therebetween.

Generally, prior art devices are substantially more cumbersome, labor intensive, and limited in bandwidth capability as well as systems applications. The present invention eliminates these shortcomings and further improves the reliability and quality of spiral antennas in general.

SUMMARY OF THE INVENTION

The present invention is embodied as a broadband, unidirectional, dual arm, planar, spiral antenna copper etched on opposite sides of two dielectric substrates providing a planar edge connecting balun capability and a stripline configuration feed for one of the spiral antenna arms.

OBJECTS OF THE INVENTION

It is an object of the invention to provide a dual arm planar spiral antenna.

It is also an object of the present invention to provide a broadband antenna with improved performance, reliability and frequency range.

It is a further object of the present invention to provide a broadband antenna having a circularly polarized unidirectional beam.

Yet another object of the present invention is to provide for a spiral antenna which may utilize any one of an infinite number of differently graded spirals and which is not limited to Archimedean or logarithmic spirals only.

A further object of the present invention is to provide an improved balun connection for improved high frequency antenna performance.

Still another object of the present invention is to provide a stripline configuration feed for one of the spiral antenna arms.

Alternatively a further object of the present invention is to provide a microstrip line configuration feed for one of the spiral antenna arms.

Yet another object of the present invention is to provide a planar spiral antenna having the capability for easy integration onto a printed circuit board of other spiral antennas interconnected thereto or for ease in printed circuit board connection to discrete components such as lowpass highpass or bandpass filters thereon.

Yet another object of the present invention is to provide for a spiral antenna that can be more easily and accurately fabricated in a computer controlled environment as opposed to prior art manual design and assembly of the components thereof.

A further object of the present invention is to provide a means for terminating the spiral arms to give the impression of the theoretically required infinite spiral for improved low frequency performance.

Yet another object of the present invention is to provide means for eliminating undesired radiation leakage from the antenna.

These and other objects, purposes, characteristics, and features of the present invention will in part be pointed out as the description of the present invention progresses and in part be obvious from the accompanying drawings.

DESCRIPTION OF THE PREFERRED EMBODIMENT

Although the terms stripline and microstrip are generally used interchangeably in the art to refer to a type of printed circuit layout and interconnection method used for circuits that operate at very high frequencies, usually above one gigahertz, the present disclosure defines herein a difference between the two. Microstrip is defined to be a microwave transmission component in which a single conductor is supported above a single ground plane. Stripline is defined to be a microwave transmission component in which a single conductor is supported between two ground planes.

Figure 1:
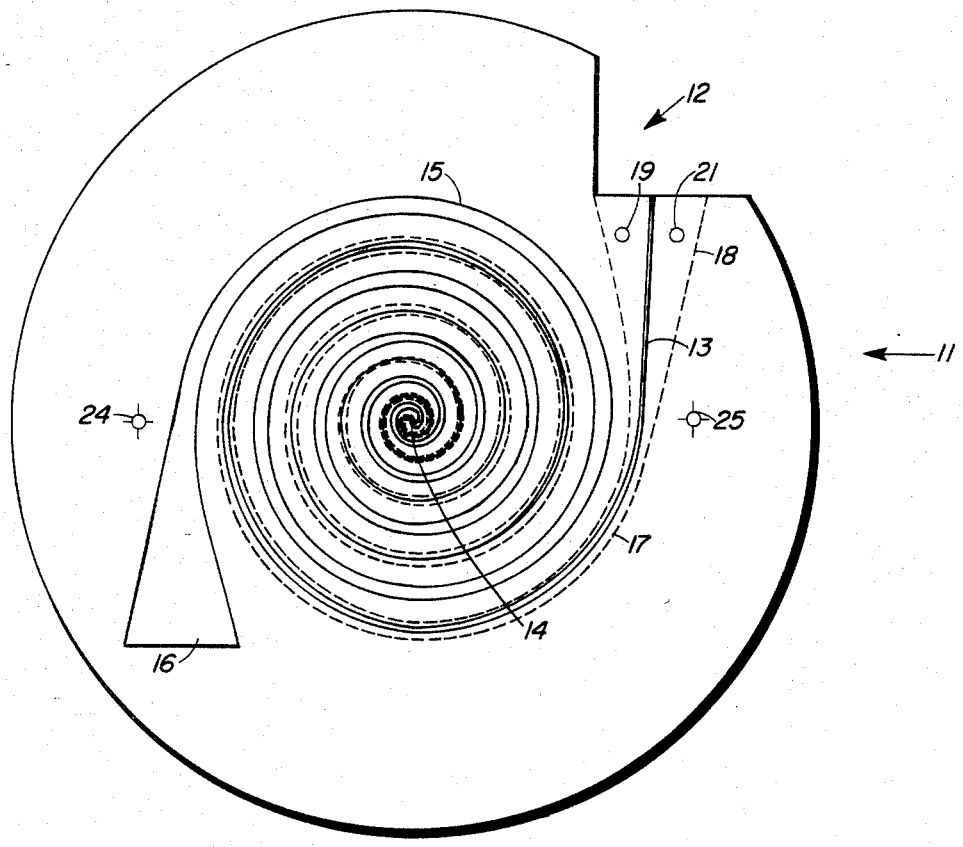
FIG. 1 illustrates a plan view of the first dielectric substrate with spirals on both sides of the sheet.

Referring now to FIG. 1 a circular first dielectric substrate 11 is provided with an edge connecting feed junction 12. A conductor feed line 13 of diminishing width begins at feed junction 12 and thereafter spirals inwardly in a clockwise direction to a spiral center 14, at which point feed line 13 reverses direction, begins spiraling outwardly in a counter-clockwise direction gradually increasing in width at a predetermined rate and becomes a first radiating spiral 15 which finally terminates on the outer periphery thereof at an enlarged balanced termination pad 16. A second radiating spiral 17 on the reverse side of dielectric substrate 11 begins at feed junction 12 at a second enlarged balanced pad 18 and can be seen through dielectric 11 to spiral inwardly in a clockwise manner gradually diminishing in width at a predetermined rate in like manner to said first radiating spiral 15 and following the path of conductor feed line 13, finally terminating on the opposite side of dielectric 11 at center 14.

First and second mounting holes 19 and 21 are provided in the present embodiment for convenience in mounting by connector means the shield of a coax cable to balance pad 18, although the invention should not be considered limited to this configuration. The center feed of said coax cable would then connect to conductor feed line 13 at feed junction 12. Finally, first and second alignment target spots 24 and 25 are provided in the present embodiment for convenience and accuracy in manufacturing the spiral antenna.

The above description describes the microstrip embodiment of the present invention. First radiating spiral arm 15, connected to the center conductor of a coaxial cable via conductor feed line 13 provides one arm of the spiral antenna of this invention disposed on one side of dielectric substrate 11. The second spiral radiating arm 17 disposed on the opposite side of dielectric 11 connected to the shield portion of a coax cable provides the second radiating arm of the spiral antenna. Though the antenna arms as described are disposed on opposite sides of a dielectric, the thickness of said dielectric is not significant or at most nominal and the antenna as constructed radiates a circularly polarized beam in a very desirable manner. The electric field normally associated with conductor feed line 13, which can cause undesirable interference patterns at high frequencies, is substantially curtailed if not eliminated by the microstrip construction, in that said lines are tightly coupled to second spiral 17 on the opposite side of dielectric 11 which acts as a conducting ground plane for the microstrip array. However, as ground plane/spiral arm 17 approaches in width the dimension of feed line 13, near center 14, the electric field is not so contained. Therefore, a dual ground plane stripline version was implemented.

Figure 2:
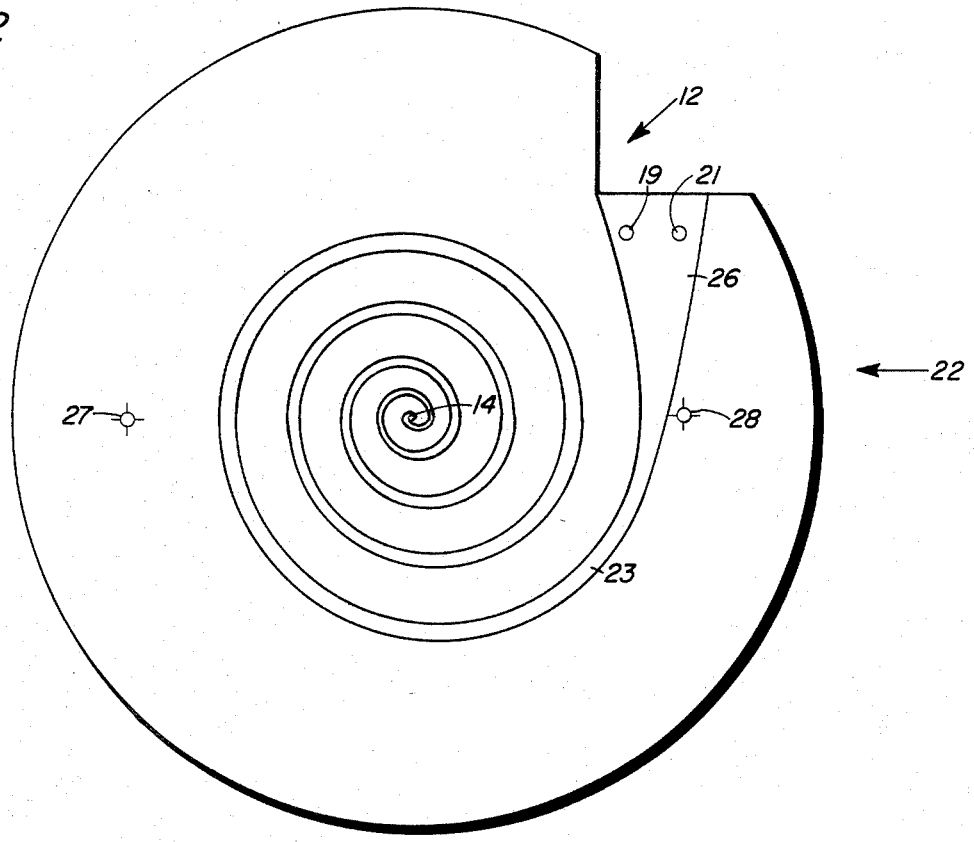
FIG. 2 illustrates a plan view of the second dielectric substrate with a spiral on but one side of the sheet.

The stripline version of the present invention is provided by superimposing a third clockwise radiating spiral 23 imprinted on a second circular dielectric substrate 22 illustrated in FIG. 2 similar in form to said first dielectric substrate. The opposite side of dielectric substrate 22 being blank is permanently bonded to the first side of dielectric substrate 11 in a manner that enables third radiating spiral 23 to parallel both second radiating spiral 17 and conductor feed line 13. Second dielectric substrate 22 likewise is provided with an edge connecting feed junction 12, first and second mounting holes 19 and 21 and commences at a third enlarged balanced pad 26, thereafter spiraling inwardly in a clockwise direction gradually decreasing in width in a manner identical to second radiating spiral 17 until it terminates at spiral antenna center 14. Third and fourth alignment spots 27 and 28 again are provided for convenience and accuracy in manufacturing and in assembling the spiral antenna device.

Conductor feed line 13 is now paralleled in its clockwise spiral progression inwardly by second radiating spiral 17 on one side and third radiating spiral 23 on an opposite side thereby providing a dual ground plane stripline configuration spiraling clockwise inwardly to spiral antenna center 14. It should be noted that conductor 13 width in either microstrip or stripline version is gradually diminished in width along the spiral for impedance matching the lower impedance balun input with the higher impedance spiral center.

Figure 3:
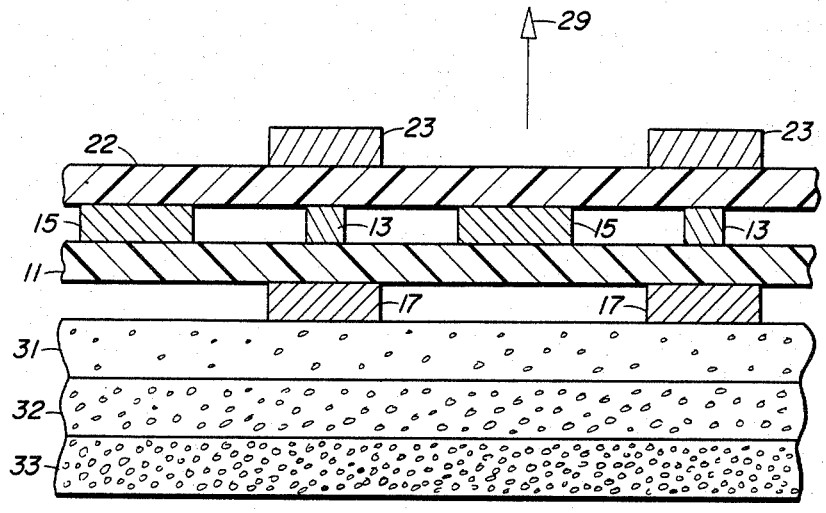
FIG. 3 depicts an elevational view of a non-specific cross-section of the spiral antenna describing the stripline configuration of the conductor line spiral.

The structure of the above described stripline configuration spiral antenna can more clearly be understood in view of FIG. 3. FIG. 3 is a non-specific cross-section or edge view of the spiral antenna as assembled wherein second dielectric substrate 22 is superimposed on first dielectric substrate 11. The stripline configuration is evidenced by noting third radiating spiral arm 23 disposed on one side of conductor feed line 13 and second radiating spiral arm 17 disposed on an opposite side thereof. Alternately disposed between said stripline configuration and between first and second dielectric substrates 11 and 22 lies first spiral radiating arm 15.

Dielectric substrates 22 and 11 in the present embodiment are composed of teflon fiberglass material but it is understood that any low loss dielectric material could likewise be used. Likewise the spiral arms as well as the conductor strip are copper etched on the present dielectric substrates, but again it is understood that any equivalent conductive material could be used in place thereof.

The antenna as constructed will radiate in the direction of arrow 29. Radiation in the opposite direction is absorbed rather than reflected by three layers of gradual transition to a heavy absorbing layer. A lossless layer 31 is first bonded to the rear of the spiral antenna followed by a medium lossy foam layer 32, and subsequently followed by a heavy lossy foam layer 33. It is to be understood that the thickness of the various layers has been greatly exaggerated for clarity and perspective in understanding the constituent components thereof.

Each of the above described five layers the two layers of dielectric material and three layers of foam material are permanently bonded together by conventional means using standard adhesives for such materials or by various heat treatment methods known to those experienced in the art. In addition, a ring of heavy lossy foam material surrounds the periphery of the spiral antenna dielectric substrates to attenuate stray radiation reflection or leakage around the edge of the spiral antenna device.

To accommodate the theoretical necessity that the arms of a spiral antenna in general must be infinite in length and not terminated short thereof thereby causing transmission energy reflections along said spiral arms, resistive elements are tied to the ends of each spiral arm as follows. Balanced termination pad 16 of first spiral antenna 15 is coupled to ground by a resistive element. Terminal balanced pad 18 of second radiating spiral antenna 17 is coupled to third enlarged balanced pad 26 of third radiating spiral 23 and each are then coupled again to ground through a second resistive element.

Figure 4:
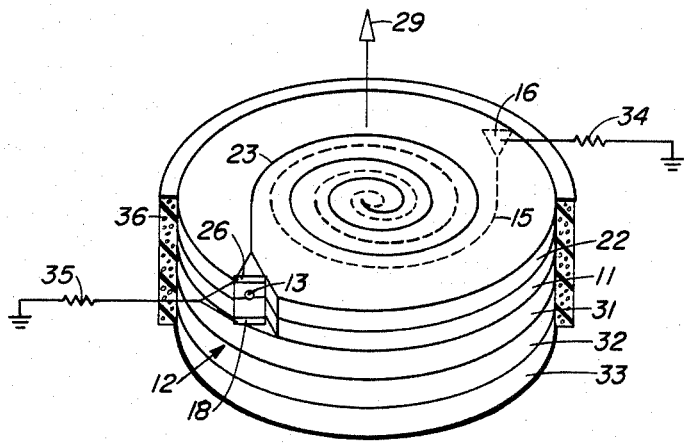
FIG. 4 illustrates a cutaway view of the several layers of the assembled spiral antenna.

Referring now to FIG. 4 an elevational view of the composite spiral antenna system is provided in a partly cutaway sectional form. Again it is to be understood that the thickness of the various layers has been greatly exaggerated for clarity and perspective in understanding the constituent components thereof. It can be seen in FIG. 4 that second dielectric substrate 22 lies on top of first dielectric substrate 11. Below first dielectric substrate 11 lies a low loss absorbing material such as lossless foam layer 31, medium lossy foam layer 32, and heavy lossy foam layer 33 which absorb and eliminate radiation in that direction from the antenna. Annular lossy foam ring 36 mentioned above is cut away to show the various layers above described. Third radiating spiral 23 can be seen on the top surface of second dielectric substrate 22 and parallels second radiating spiral 17 on the bottom of first dielectric substrate 11, shown as balanced pad 18 edge only. Terminal balance pad 18 of second radiating spiral 17 is shown coupled to terminal balance pad 26 of third radiating spiral 23, both of which are coupled through resistive element 35 to ground. Balance pad 16 of first radiating spiral 15 is likewise shown coupled through a second resistive element 34 to ground. Conductor feed line 13 which travels between and parallel to second radiating spiral 17 and third radiating spiral 23 is shown terminated at edge connecting feed junction 12. Direction and propagation of the antenna as constructed and described is shown by arrow 29.

In the following discussion of method and mode of operation of the above described antenna it should be observed that both second spiral radiating arm 17 and third spiral radiating arm 23 being coupled together function in the same manner, and so reference will be made, in describing the operation of the above described antenna, by addressing only third radiating spiral 23 and first radiating spiral 15 as described in FIG. 4. Furthermore, it should be understood that antennas such as the presently described antenna generally are provided with radomes for protection. In the present invention second dielectric substrate 22 can and does serve as an effective randome for first dielectric substrate 11 and components thereof.

Figure 5:
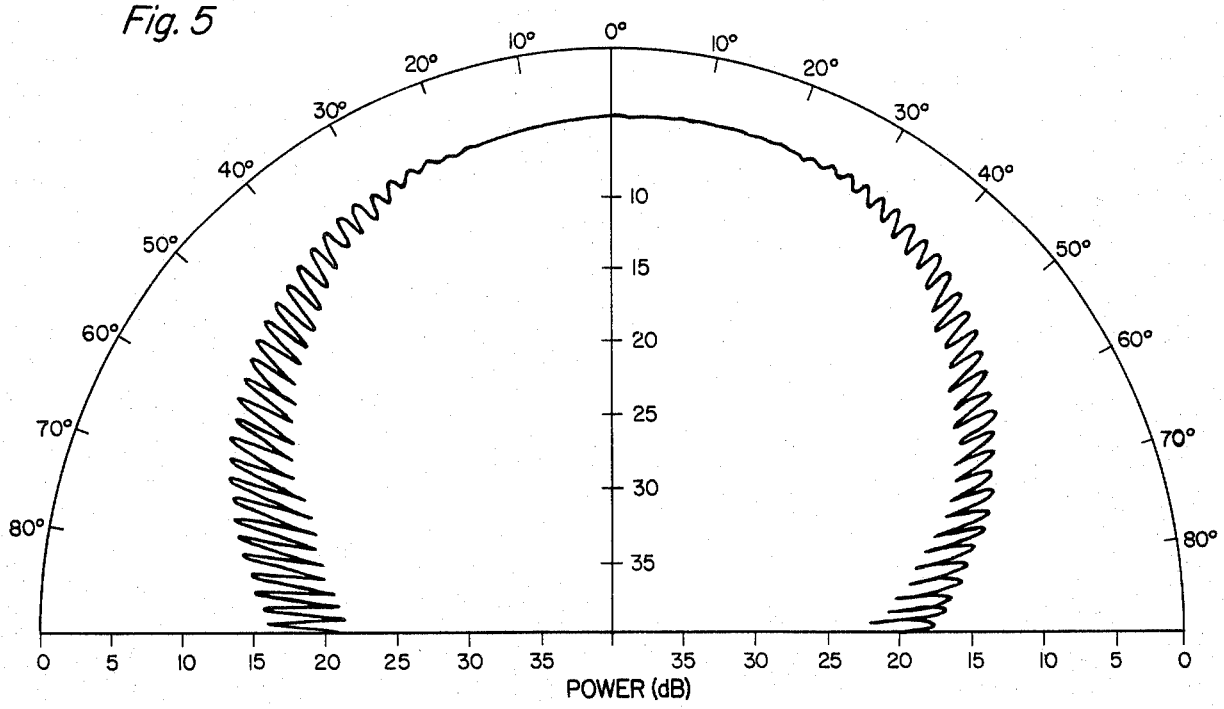
FIG. 5 depicts the spatial power distribution (antenna pattern) for a VHF signal of the spiral antenna described in this disclosure.

One mode of operation of the above described spiral antenna is to connect a coaxial cable at edge connecting feed junction 12. The center element of the coaxial cable is coupled to conductor feed line 13, while the outer shield portion of said coaxial cable is coupled to balanced terminating pad 26. For the antenna to operate satisfactorily each spiral arm must be provided with a signal at the center of the spiral that is 180° out of phase with the opposite arm. First radiating spiral 15 is fed a signal by conductor feed line 13 at its center 14. Third radiating spiral 23, being connected to the shield of the coax cable at one end of the spiral and open-ended at the opposite end, observes a discontinuity at the center of the spiral 14, the signal being reflected at said point 180° out of phase with the signal in spiral 15. When so constructed the dual arm spiral antenna will radiate a circularly polarized beam in one direction as illustrated in FIG. 5.

It should be obvious that the above described planar spiral antenna comprising basically two printed circuit boards can be constructed as but a part of a larger printed circuit board coupled with other spiral antennas or other electronic component devices. Furthermore, it is not necessary that the above described antenna be provided with a coaxial feed, but can be powered by a printed circuit edge connector or any means as long as the two spiral arms are provided with signals that are 180° out of phase.

Although there has been described hereinabove a particular arrangement of a spiral antenna for the purpose of illustrating the manner in which the invention may be used to advantage, it will be appreciated that the invention is not limited thereto. Accordingly any and all modifications, variations or equivalent arrangements which may occur to those skilled in the art, should be considered to be within the scope of the invention as defined in the appended claims.

We claim:

1. A broadband antenna, comprising:

a first planar dielectric substrate having first and second surfaces;

a spiral conductor formed on said first surface of said first planar dielectric substrate, said conductor originating at an input balun on the outer periphery of said spiral conductor and spiraling inwardly to a center termination;

a first spiral radiator formed on said first surface of said first planar dielectric substrate, said first spiral radiator originating at and coupled to said center termination of said spiral conductor and thereafter spiraling outwardly equidistant between successive rings of said spiral conductor and terminating on the outer periphery of said first spiral radiator at a first balance pad, said first radiator increasing in width along the spiral from said center termination to said balance pad; and a second spiral radiator formed on said second surface of said first planar dielectric substrate, said second radiator originating at a second balance pad on the outer periphery of said second spiral radiator and spiraling inwardly to a center termination, said second radiator decreasing in width in a balancing manner with said first radiator spiral along the spiral from said second balance pad to said center termination and being coextensive with said spiral conductor forming a first ground plane.

2. A broadband antenna as set forth in claim 1, further comprising:

a second planar dielectric substrate having first and second surfaces, said first surface of said second dielectric substrate being bonded to said first surface of said first dielectric substrate; and a third spiral radiator formed on said second surface of said second dielectric substrate, said third radiator originating at a third balance pad on the outer periphery of said third spiral radiator and spiraling inwardly in a balancing manner with said first radiator spiral to a center termination, said third spiral radiator decreasing in width from said third balance pad to said center termination and being coextensive with said spiral conductor forming a second ground plane.

3. A broadband antenna as set forth in claim 1 further comprising:

a first layer of low loss absorbing material bonded to said second surface of said surface planar dielectric substrate for electronic isolation of said third spiral radiator;

a second layer of medium grade lossy foam material bonded to said low loss absorbing material forming a buffer zone;

a third layer of heavy grade lossy foam material bonded to said second layer forming a radio frequency absorbing barrier; and a ring of heavy grade lossy foam material surrounding the periphery of said antenna;

whereby said antenna is isolated from radio frequency radiation incident upon said second surface of said second dielectric substrate for rendering said antenna unidirectional.

4. A broadband antenna as set forth in claim 1 wherein said spiral conductor and said first and second spiral radiators are metal etched on said first dielectric substrate.

5. A broadband antenna as set forth in claim 4 wherein said metal is copper.

6. A broadband antenna according to claim 1 wherein said antenna comprises a component part of a printed circuit board.

7. A boardband antenna according to claim 1 wherein said first dielectric substrate is teflon fiberglass.

8. A broadband antenna as set forth in claim 1 having resistive means coupling each of said first and second balance pads at the outer periphery of each of said first and second spiral radiating arms to ground to give the effect of an infinite arm length.

9. A broadband antenna as set forth in claim 2 wherein said third spiral radiator is metal etched on said second dielectric substrate.

10. A broadband antenna according to claim 9 wherein said metal is copper.

11. A broadband antenna according to claim 2 wherein said antenna comprises a component part of a printed circuit board.

12. A broadband antenna according to claim 2 wherein said second dielectric substrate is teflon fiberglass.

13. A broadband antenna according to claim 2 having resistive means coupling said third balance pad at the outer periphery of said third spiral radiating arm to ground to give the effect of an infinite arm length.

14. A dual arm spiral antenna, comprising:

A first planar dielectric substrate having first and second sides;

a first planar spiral radiating arm disposed on said first side of said first planar dielectric substrate;

a second planar spiral radiating arm disposed on said second side of said first planar dielectric substrate;

planar spiral means, disposed on said second side of first planar dielectric substrate, for center feeding said second spiral radiating arm, and for impedance balancing/matching a center feed point with an outer extremity of said planar spiral feed means.

15. A spiral antenna according to claim 14 wherein said first and second spirals are metal etched on said first and second sides of said dielectric substrate.

16. A spiral antenna as set forth in claim 14 wherein each spiral arm is fed a signal that is 180° out of phase from the signal fed to the other spiral arm.

17. A spiral antenna as set forth in claim 14, wherein said planar spiral means for balancing/matching impedance comprises a spiral conductor feed line originating at an initial width at said outer periphery following the path of said first radiating arm in a microstrip fashion, and decreasing in width as said feed line spirals inwardly to said center feed, thereby increasing the impedance of said feedline to match the impedance at said center feed with that at said outer periphery.

18. A dual arm spiral antenna according to claim 17 further including a second planar dielectric substrate having a first and second sides, wherein said first side of said second planar dielectric substrate is layered over said second side of said first planar dielectric substrate.

19. A dual arm spiral antenna according to claim 18 wherein said second planar dielectric substrate has a third planar spiral radiating arm disposed on said second side of said second planar dielectric substrate coupled to and following the path of said first planar spiral radiating arm in a manner to contain said conductor feedline therebetween in a stripline fashion.

* * * * *